US005530426A

United States Patent [19]

Wilk

[11] Patent Number: 5,530,426

[45] Date of Patent: Jun. 25, 1996

[54] SYSTEM AND ASSOCIATED METHOD FOR PROTECTING VALUABLE PERSONAL POSSESSIONS

[76] Inventor: Peter J. Wilk, 185 W. End Ave., New York, N.Y. 10023

[21] Appl. No.: 491,126

[22] Filed: Jun. 16, 1995

[51] Int. Cl.[6] ..... G08B 13/22

[52] U.S. Cl. ..... 340/531; 340/539; 340/568; 340/572; 340/693

[58] Field of Search ..... 340/531, 539, 340/568, 693, 572

[56] References Cited

U.S. PATENT DOCUMENTS

| | | | |
|---|---|---|---|
| 4,158,197 | 6/1979 | Takagaki | 340/693 |
| 4,847,592 | 7/1989 | Hogen Esch et al. | 340/572 |
| 5,086,290 | 2/1992 | Murray et al. | 340/531 |
| 5,223,815 | 6/1993 | Rosenthal et al. | 340/531 |
| 5,396,218 | 3/1995 | Olah | 340/539 |

*Primary Examiner*—Glen Swann

*Attorney, Agent, or Firm*—R. Neil Sudol; Henry D. Coleman

[57] ABSTRACT

A system for protecting valuable personal possessions comprises a first housing, a transmitter of wireless energy disposed in the first housing, a second housing, and a receiver of the wireless energy disposed in the second housing. One of the housings is attached to an earring of a user, and the other housing is attached to the person of the user. A detector is connected to the receiver to monitor the distance between the first and second housings, and an alarm signal generator connected to the detector generates an alarm when the distance between the first and second housings surpasses a predetermined maximum threshold.

15 Claims, 2 Drawing Sheets

SYSTEM AND ASSOCIATED METHOD FOR PROTECTING VALUABLE PERSONAL POSSESSIONS

BACKGROUND OF THE INVENTION

This invention relates to a method and an associated system for protecting valuable personal possessions. More specifically, this invention relates to a protection system which alerts a user when an item of personal property has been separated from the user. The method and associated system are particularly useful for preventing the loss of an earring.

It is frequently the case that the most valuable possessions kept on one's person are among the lightest. A pocketbook containing credit cards, cash, and important personal information can weigh as little as a few ounces, and jewelry, particularly when adorned with precious metals and gems, can be of substantially greater value while weighing even less. For this reason, the personal items one dreads most to lose are often those most likely to go unnoticed when lost.

The inability to immediately and easily sense the loss of such an object contributes to the difficulty of pinpointing the time and place where that object was lost, and its recovery becomes substantially a matter of guesswork and luck. Because of this notorious problem, even where an item of property is securely fastened to the person, he or she often feels ill at ease and persists in checking for the continued presence of the item.

In particular, earrings are useful only when they are exposed, and it is then that they are at the greatest risk of being irretrievably lost.

OBJECTS OF THE INVENTION

An object of the present invention is to provide a method for protecting certain kinds of valuable possessions.

A related object of the present invention to provide a system for protecting certain kinds of valuable possessions.

A particular object of the present invention is to provide a system and an associated method of alerting a user that an earring is in danger of being lost.

A more specific object is to provide such a system that can be used with a variety of earrings.

These and other objects of the present invention will be apparent from the drawings and detailed descriptions herein.

SUMMARY OF THE INVENTION

A method for protecting valuable personal possessions in accordance with the present invention comprises the steps of (a) providing a transmitter of wireless energy on a first earring and a receiver of wireless energy on a second earring of a matched pair; (b) attaching the first earring to one ear of a user, and the second earring to the other ear of the user; (c) operating the transmitter and the receiver to continually monitor the distance between the transmitter and the receiver; and (d) upon detecting that the distance has increased above a predetermined maximum threshold, issuing an alarm signal sensible by the user.

The step of issuing an alarm signal may include the step of generating the alarm signal at the receiver.

The alarm signal may be an auditory signal. In that case, the step of issuing the alarm signal includes the step of energizing an electroacoustic transducer operatively connected the receiver.

Alternatively, the alarm signal may be a tactile signal. Then, the step of issuing the alarm signal includes the step of energizing an electromechanical transducer operatively connected to the receiver.

According to a specific feature of the present invention, the step of operating the transmitter and receiver includes the step of comparing, with a predetermined magnitude, the intensity of the wireless energy upon reception thereof by the receiver.

Where the wireless energy is electromagnetic, the step of operating the transmitter and receiver includes the step of energizing the transmitter to emit electromagnetic waves. Where the wireless energy is acoustic, the step of operating includes the step of energizing the transmitter to emit ultrasonic pressure waves.

A system for protecting valuable personal possessions in accordance with the present invention comprises a transmitter of wireless energy disposed in a first housing and a receiver of wireless energy disposed in a second housing. A first attachment component serves to fasten one of the housings to an earring of a user. A second attachment component similarly fastens the other housing to the person of the user. A detector operatively connected to the receiver and disposed in the second housing continually monitors the distance between the transmitter and the receiver and detects when the distance has surpassed a predetermined threshold. An alarm signal generator operatively connected to the detector and disposed in the second housing issues an alarm signal upon a determination by the detector that the distance has surpassed the predetermined threshold.

According to another feature of the present invention, the housing attached to the earring of the user is shaped as an integral component of the earring. Additionally, the other housing may be shaped as an integral component of another earring.

The alarm signal generator may include an electroacoustic transducer operatively connected to the receiver. Alternatively or additionally, where the first housing is coupled to the first attachment component and the second housing is coupled to the second attachment component, i.e., where the receiver is attached to the person of the user, the alarm signal generator may include an electromechanical transducer operatively connected to the receiver for producing a vibration detectable via the skin of the user.

According to a more particular feature of the present invention, the detector includes componentry for comparing, with a predetermined magnitude, the intensity of the wireless energy upon reception thereof by the receiver.

Where the wireless energy is electromagnetic, the transmitter includes componentry for emitting electromagnetic waves. Where the wireless energy is acoustic, the transmitter includes componentry for emitting ultrasonic pressure waves.

A system for protecting valuable personal possessions in accordance with the present invention reduces the risk that an earring will be irretrievably lost. The user or wearer of the earring is alerted immediately upon separation of the earring from the user, an event that is likely to go unnoticed otherwise. After being alerted of the loss, the user can retrieve the earring instead of leaving it behind.

DETAILED DESCRIPTION

Figure 1A:
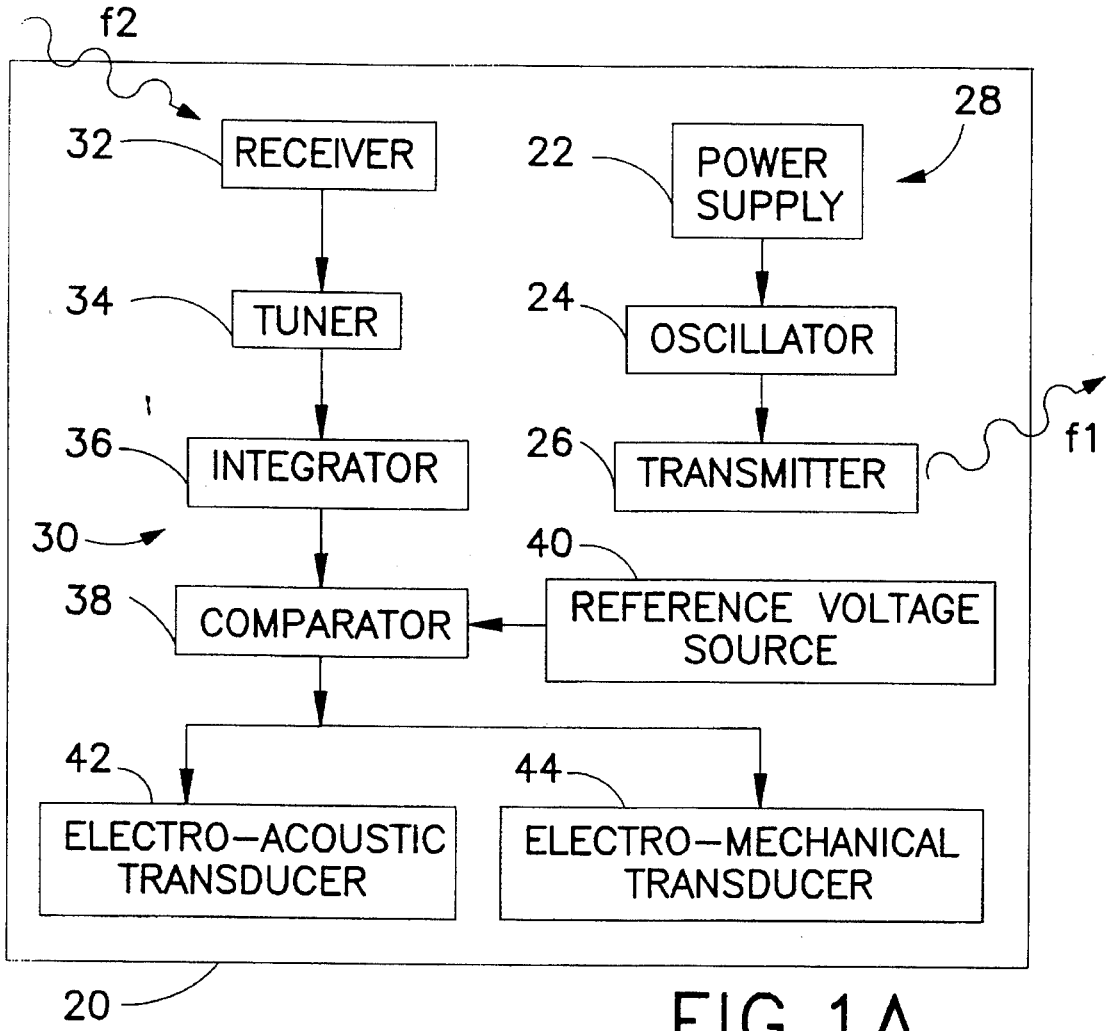
FIGS. 1A and 1B are block diagrams of transmitter and receiver circuits for use in a system in accordance with the present invention for protecting valuable personal possessions.

As illustrated in FIG. 1A, a device for protecting valuable valuable personal possessions includes a transmitter circuit 28 and a receiver circuit 30 mounted in a housing 20. A power supply 22 disposed in housing 20 supplies energy to an oscillator 24. Oscillator 24 then feeds an oscillating electrical current to a transmitter 26 of wireless energy. Transmitter 26 may take the form of a radio antenna for transmitting electromagnetic wave energy. In that case, oscillator 24 provides a radio frequency voltage to transmitter 26. Alternatively, transmitter 26 is an electromechanical transducer producing ultrasonic energy. In that case, oscillator 24 generates an alternating current of an ultrasonic frequency. The wireless energy transmitted by transmitter 26 is of a predetermined frequency f1.

In receiver circuit 30, a receiver 32 converts incoming wireless energy to an electrical voltage. Receiver 32 can be a receiver of ultrasonic energy or a receiver of electromagnetic energy. Signals from receiver 32 are filtered by a tuner 34 to eliminate all signals except those of a predetermined frequency f2 different from f1. Signals of frequency f2 are conveyed to an integrator 36, which outputs a voltage proportional to the strength of the signal from tuner 34. A comparator 38 at an output of integrator 36 compares the output signal from the integrator with a preselected reference voltage from a source 40.

If the voltage from comparator 38 falls below the reference voltage from source 40, comparator 38 energizes an alarm signal generator such as an electroacoustic transducer 42 and/or an electromechanical transducer 44. Electroacoustic transducer 42 generates an audible alarm signal, while electro-mechanical transducer 44 generates a tactile alarm signal, such as a low-frequency vibration.

Figure 1B:
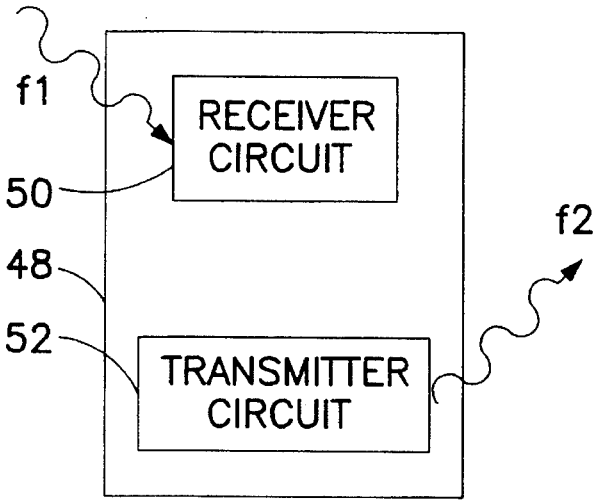

FIG. 1B depicts a device for cooperating with the device of FIG. 1A to form a system for protecting valuable personal possessions. The device of FIG. 1B includes a transmitter circuit 52 and a receiver circuit 50 mounted in a housing 48. Transmitter circuit 52 is similar to transmitter circuit 28 except that transmitter circuit 52 transmits wireless energy of frequency f2 for reception by receiver circuit 30. Likewise, receiver circuit 50 receives wireless energy of frequency f1 transmitted by transmitter circuit 28.

Figure 2:
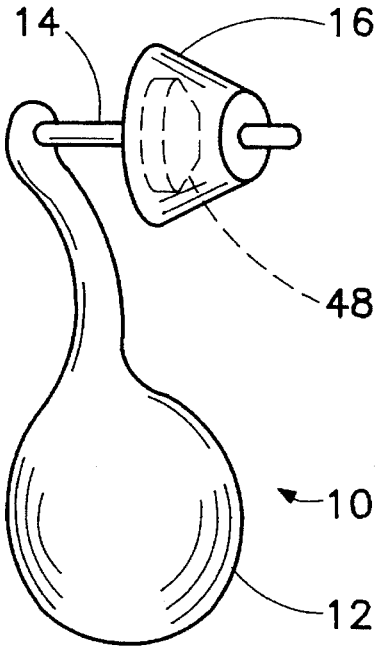
FIG. 2 is a schematic perspective view of an earring employing a transmitter and receiver circuit as illustrated in FIG. 1A or 1B.

As shown in FIG. 2, an earring 10 comprises a body 12 having a post or stem 14. Post 14 is inserted through a pierced earlobe of a user and is secured with removable locking component 16. Housing 48 (FIG. 1B) is integral with or disposed within locking component 16. Housing 20 (FIG. 1A) is attached to the person of the user, for example, by being disposed in another earring locking component. During use of the system of FIGS. 1A and 1B, transmitter circuits 28 and 52 continually emit wireless energy detectible by receiver circuits 50 and 30, respectively. When housings 48 and 20 are close to one another, the signal received by receiver circuit 30 from transmitter circuit 52 is sufficiently strong so that the voltage from integrator 36 is higher than the reference voltage and transducer 42 and/or 44 is not activated. As housings 20 and 48 are separated by a greater distance, the signal received by receiver circuit 30 from transmitter circuit 52 becomes weaker, until the voltage from integrator 36 falls below the reference voltage from source 40. At this point, comparator 38 activates transducer 42 and/or 44.

The reference voltage from source 40 is selected such that the activation of transducer 42 and/or 44 occurs only after housings 48 and 20 are separated by a predetermined distance, which is greater than a large head width. Such a separation will happen, for example, when locking component 16, containing housing 48, falls from post 14 of earring 10. With such a separation, the activation of transducer 42 and/or 44 serves as an alarm signal to make the user aware that at least one earring 10 is in danger of being lost. Because of its proximity to the ear of the user, electroacoustic transducer 42 can be very small and still produce a signal audible to the user. Likewise, due to the sensitivity of the earlobe, electromechanical transducer 44 need not be large to produce vibrations sensible to the user.

Analogously, if housing 48 remains attached to an ear of the user and housing 20 falls away, the user will be warned by a sensible alarm signal issuing from one or more transducers (not shown) in housing 48.

Figure 3:
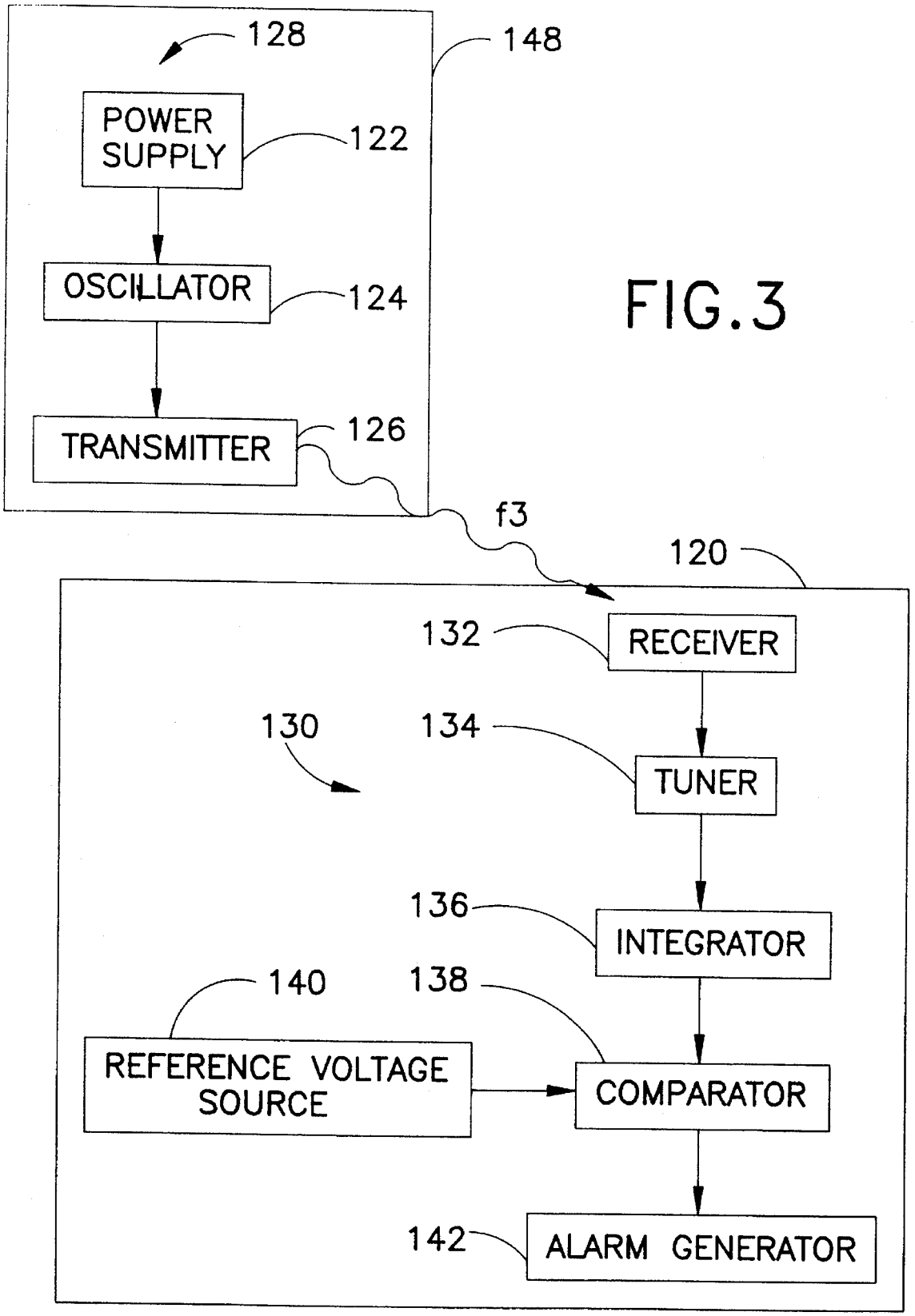
FIG. 3 is a block diagram of another transmitter circuit and a receiver circuit for use in a system for protecting valuable personal possessions in accordance with the present invention.

In another embodiment of the present invention (FIG. 3), there is only one transmitter circuit 128 and one receiver circuit 130, which are disposed in respective housings 148 and 120, respectively. Analogous to transmitter circuit 28, transmitter circuit 128 comprises a power supply 122 driving an oscillator 124 to produce a signal of frequency f3, which is wirelessly emitted by a transmitter 126. In housing 120, a receiver 132 receives the wireless energy, which is filtered by a tuner 134 to eliminate all signals but those of frequency f3. An integrator 136 provided downstream of tuner 134 outputs a voltage proportional to the strength of the filtered signal from tuner 134. When the output voltage from integrator 136 falls below a reference voltage from a source 140, a comparator 128 connected to integrator 136 and source 140 activates an alarm signal generator 142.

When transmitter circuit 128 is sufficiently near to receiver circuit 130, the output voltage from integrator 136 is higher than reference voltage 140, and alarm generator 142 remains de-energized. As the distance between housings 120 and 148 increases, the output voltage from integrator 136 falls until the output voltage from integrator 136 falls below the reference voltage from source 140, and comparator 138 activates alarm generator 142.

Each of the housings 120, 148 is fixed to a separate earring (not shown), and each earring is attached to an ear of the user. Transmitter circuit 128 operates continually to emit wire-less energy of frequency f3, while receiver circuit 130 operates to monitor the distance between housings 120 and 148 by measuring the strength of the incoming wireless signal relative to reference voltage 140. When an earring fixed to one of housings 120, 148 falls away from an ear of the user, the distance between housings 120 and 148 exceeds the predetermined maximum threshold and alarm generator 142 signals the user that an earring is in danger of being lost.

Of course, it will be apparent that housings 20, 48, 120, and 148 need not be disposed inside an earring locking device such as locking device 16. For example, any or all of housings 20, 48, 120, and 148 can be disposed in an earring body such as body 12, or held otherwise to the person of the user.

Switches (not shown) may be provided for disabling transmitter circuits 28, 52, 128 when the earrings 10 are not in use.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are profferred by way of example to facilitate comprehension of the invention and should not be construed to limit the scope thereof.

What is claimed is:

1. A method for protecting valuable personal possessions, comprising the steps of:

providing a transmitter of wireless energy on a first earring and a receiver of wireless energy on a second earring of a matched pair;

attaching said first earring to a first ear of a user and securing said second earring to a second ear of the user;

operating said transmitter and receiver to continually monitor a distance between said transmitter and receiver; and upon detecting that said distance has increased above a predetermined maximum threshold, issuing an alarm signal sensible by the user.

2. The method defined in claim 1 wherein said step of issuing includes the step of generating said alarm signal at said receiver.

3. The method defined in claim 1 wherein said alarm signal is auditory, said step of issuing including the step of energizing an electroacoustic transducer operatively connected to said receiver.

4. The method defined in claim 1 wherein said alarm signal is tactile, said step of issuing including the step of energizing an electromechanical transducer operatively connected to said receiver.

5. The method defined in claim 1 wherein said step of operating includes the step of comparing, with a predetermined magnitude, an intensity of said wireless energy upon reception thereof by said receiver.

6. The method defined in claim 1 wherein said wireless energy is electromagnetic, said step of operating including the step of energizing said transmitter to emit electromagnetic waves.

7. The method defined in claim 1 wherein said wireless energy is acoustic, said step of operating including the step of energizing said transmitter to emit ultrasonic pressure waves.

8. A system for protecting valuable personal possessions, comprising:

a first housing;

a transmitter of wireless energy, said transmitter being disposed in said first housing;

a second housing;

a receiver of said wireless energy, said receiver being disposed in said second housing;

first attachment means on said first housing for attaching one of said first housing and said second housing to an earring of a user;

second attachment means on said second housing for attaching the other of said first housing and said second housing to the person of the user;

detector means operatively connected to said receiver and disposed in said second housing for continually monitoring a distance between said transmitter and receiver and for detecting when said distance has surpassed a predetermined threshold; and alarm signal generator means operatively connected to said detector means and disposed in said second housing for issuing an alarm signal upon a determination by said detector means that said distance has surpassed said predetermined threshold.

9. The system defined in claim 8 wherein said one of said first housing and said second housing is shaped as an integral component of said earring.

10. The system defined in claim 9 wherein said other of said first housing and said second housing is shaped as an integral component of another earring.

11. The system defined in claim 8 wherein said alarm signal generator means includes an electroacoustic transducer operatively connected to said receiver.

12. The system defined in claim 8 wherein said alarm signal includes an electromechanical transducer operatively connected to said receiver for generating a vibration detectable via the skin of the user, said first housing being attached to said first attachment means and said second housing being attached to said second attachment means.

13. The system defined in claim 8 wherein said detector means includes means comparing, with a predetermined magnitude, an intensity of said wireless energy upon reception thereof by said receiver.

14. The system defined in claim 8 wherein said wireless energy is electromagnetic, said transmitter including means for emitting electromagnetic waves.

15. The system defined in claim 8 wherein said wireless energy is acoustic, said transmitter including means for emitting ultrasonic pressure waves.

* * * * *